US006442879B1

(12) United States Patent
Callendar et al.

(10) Patent No.: US 6,442,879 B1
(45) Date of Patent: Sep. 3, 2002

(54) APPARATUS FOR DISPLAY OF MEMORABILIA

(76) Inventors: Rod Callendar, 6 Forest Court, Gladstone Park VIC (AU); Les White, 6 Forest Court, Gladstone Park VIC (AU)

( * ) Notice: Subject to any disclaimer, the term of this patent is extended or adjusted under 35 U.S.C. 154(b) by 0 days.

(21) Appl. No.: 09/903,076

(22) Filed: Jul. 11, 2001

(30) Foreign Application Priority Data

Jan. 29, 2001 (AU) ..... PR2745

(51) Int. Cl.[7] ..... B65D 85/00; A47G 1/06
(52) U.S. Cl. ..... 40/800; 206/486
(58) Field of Search ..... 40/800; 206/486, 206/461, 8

(56) References Cited

U.S. PATENT DOCUMENTS 4,187,703 A * 2/1980 Ippoliti et al. ..... 70/63
4,653,642 A * 3/1987 Hakun et al. ..... 246/486
5,845,778 A 12/1998 Hickey, Jr.
6,128,840 A * 10/2000 Boisvert ..... 40/129.191

* cited by examiner

*Primary Examiner*—Cassandra H. Davis
(74) *Attorney, Agent, or Firm*—Volpe & Koenig, P.C.

(57) ABSTRACT

An assembly for preserving and displaying an item of memorabilia in three dimensions including a first planar substrate having an opening adapted to receive a transparent shaped memorabilia enclosure and a second hard transparent layer adapted to be co-extensively adhered to said first substrate. The transparent layer includes an opening that corresponds to the opening in the first substrate. The transparent memorabilia enclosure includes a shaped portion adapted to fit securely within the openings of the first substrate and the second layer and enclose to the item of memorabilia.

7 Claims, 1 Drawing Sheet

APPARATUS FOR DISPLAY OF MEMORABILIA

FIELD OF THE INVENTION

The present invention relates to multi-component apparatus which is adapted to enclose an item of memorabilia so that the item can be displayed clearly in three-dimensions for posterity.

BACKGROUND OF THE INVENTION

The present applicant has had occasion to preserve and present an item of memorabilia. Of particular interest to the present applicant are of items of sporting memorabilia although it is understood that memorabilia can take the form of artistic, historical, political or social items.

Given the developing commercial nature and appeal of memorabilia, particularly in sporting items, there is a real need for a means of both preserving and displaying such memorabilia.

Previously the present Applicants have filed Australian Petty Patent Application (Application No. 25287/00) which is directed to preserving an item of memorabilia by providing effectively a moulded shaped transparent layer, shaped to conform to an item of memorabilia, and a planar substrate.

It has been found by the Applicants that their earlier attempts at manufacturing the apparatus according to Petty Patent No. 25287/00, too expensive. The Applicants have also experienced noticeable flaws/imperfections in the transparent layer which occurs during the moulding process. These flaws manifest in discrete points of opaqueness/cloudiness and are particularly noticeable in planar surfaces surrounding the shaped area. Even further disadvantages noticed by the Applicants in their earlier attempts to provide a suitable assembly for displaying memorabilia is that the transparent layer is easily scratched. This becomes a significant problem because the transparent layer constitutes the entire top surface of the assembly. During handling and transport of the earlier assembly, scratching or scoring of the transparent layer occurs, whether in shaped or non-shaped moulded regions, and detracts from the overall visual appearance and commercial appeal of the fully assembled article.

Therefore there is a need to provide an apparatus or assembly which is cheaper to produce, does not exhibit or is prone to imperfections, is more readily transported, while still retaining the feature of preserving and displaying an item of memorabilia in three dimensions.

SUMMARY OF THE INVENTION

The objects of the invention are now addressed in a first aspect by an improved assembly for preserving and displaying an item of memorabilia in three-dimensions including:

- a first planar substrate, said first substrate having an opening adapted to receive a transparent shaped memorabilia enclosure;
- a second hard transparent layer, said transparent layer adapted to co-extensively abut a surface of said first substrate, said transparent layer having an opening therein corresponding to said opening in said first substrate;
- a transparent memorabilia enclosure adapted to fit securely within said openings of said first substrate and said second layer wherein the transparent memorabilia enclosure has a shaped portion so as to receive an item of memorabilia of corresponding shape said enclosure extending upwardly through said openings sitting proud of said transparent layer thus displaying an item of memorabilia held therein in three dimensions.

Because the transparent memorabilia enclosure does not form an outer layer of the assembly, it is significantly easier and cost effective to manufacture in commercial quantities and can be made from harder scratch-resistant material. Hence the present assembly enables an item of memorabilia to be displayed more clearly than prior art assemblies.

In a second aspect of the invention there is disclosed a method of preserving and displaying an item of memorabilia including an apparatus including;

- a first planar substrate, said first substrate having an opening adapted to receive a transparent shaped memorabilia enclosure;
- a second hard transparent layer, said transparent layer adapted to co-extensively abut a surface of said first substrate, said transparent layer having an opening therein corresponding to said opening in said first substrate;
- a transparent memorabilia enclosure adapted to fit securely within said openings of said first substrate and said second layer wherein the transparent memorabilia enclosure has a shaped portion so as to receive an item of memorabilia of corresponding shape said enclosure extending upwardly through said openings sitting proud of said transparent layer thus displaying an item of memorabilia held therein in three dimensions;

placing said item within said displaying enclosure, placing said enclosure within said opening in, said first substrate, and adhering said second transparent layer onto said first substrate.

Preferably the transparent memorabilia enclosure includes a planar region, extending about the periphery of the shaped portion which is adapted to abut an inner surface of the first substrate away from the transparent layer. In use the planar region abuts against an inner surface of the first substrate so as to be hidden from a viewer's plan view of said shaped portion.

Preferably the planar region and the shaped portion of said memorabilia enclosure are joined substantially at right angles to each other.

Preferably the apparatus further includes an opaque backing board so as to sandwich the planar region of said enclosure between said backing board, and said first substrate.

It is further preferred that one or more information plaques and/or one or more photographs is included in the apparatus.

Materials suitable for the construction of the transparent layer include vacform 7M PETG, hard acrylics, glass or any rigid or semi-rigid transparent plastic.

The present invention effectively hides any areas of imperfection in the enclosure, particularly at the junction between the shaped portion and the peripheral planar region, and planar regions, which may occur during plastic moulding. As stated previously planar regions of the memorabilia enclosure tend to be prone to flaws which are formed during the moulding process. Any planar regions in the instant invention are hidden from view in the present arrangement. As a result a harder material can be adopted as the transparent layer which provides higher resistance to scratching.

DETAILED DESCRIPTION OF THE PREFERRED EMBODIMENT

Figure 1:
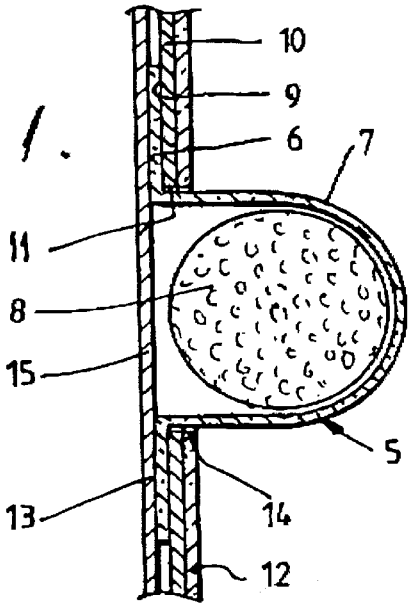
FIG. 1 is a cross-sectional view of an assembly of the invention.
Figure 2:
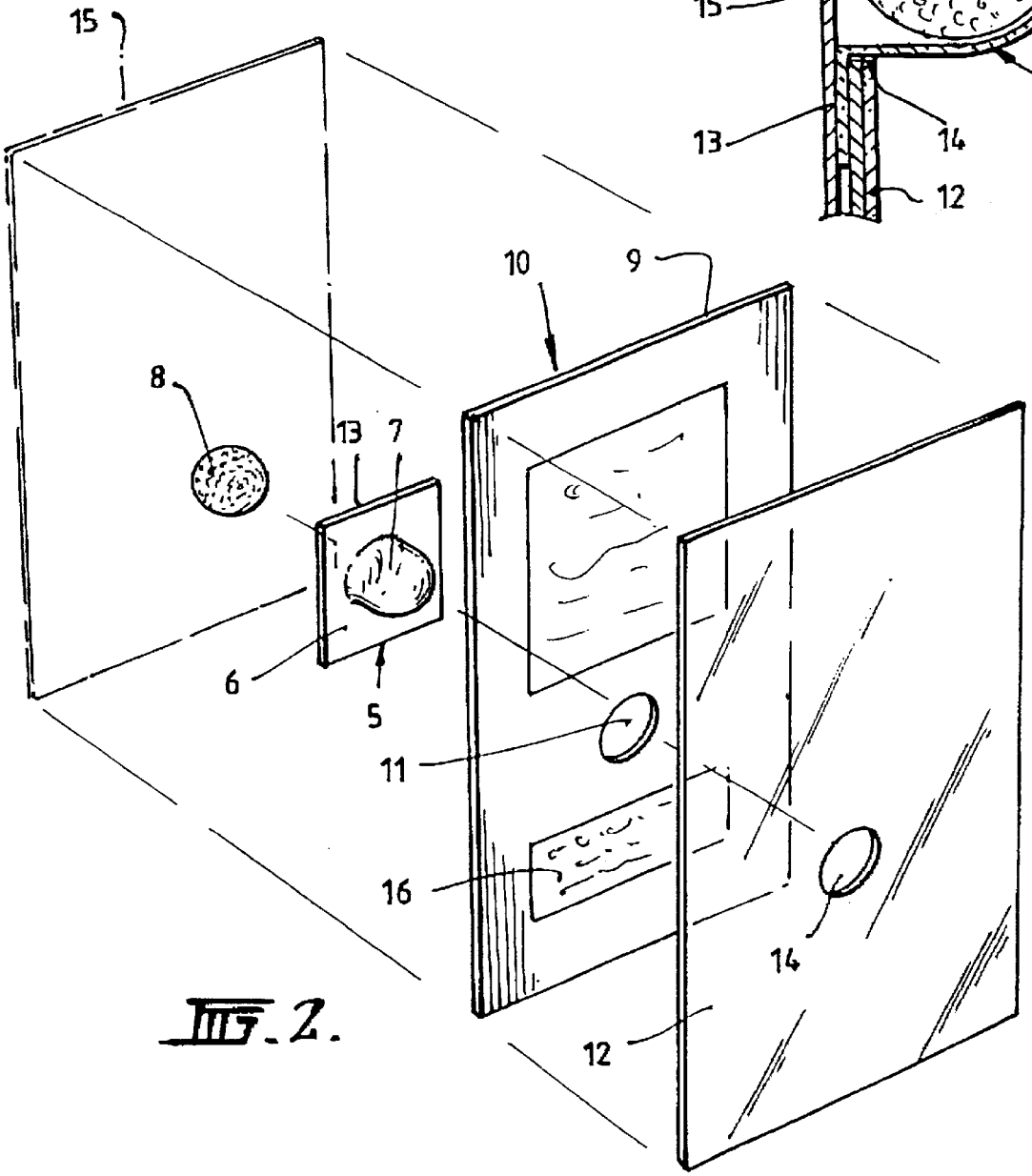
FIG. 2 is a perspective view of a transparent layer juxtaposed in relation to the first substrate.

Referring to FIGS. 1 and 2, there is illustrated an assembly according to the invention adapted to display a spherical ball such as a golf ball.

Turning to FIG. 1, there is shown a display enclosure 5 which consists of a planar portion 6 from which there extends upwardly at right angles a blister 7 for retaining therein a golf ball 8 or otherwise item of memorabilia of like shape. In the Applicants' discussion of the prior art, they have highlighted major imperfections with the planar section manifest during the moulding process. This has presented a major disadvantage because the planar portion of the memorabilia display enclosure of the prior art remains in full view.

The above disadvantage is overcome by abutting the planar section 6 against the inner surface 9 of the first substrate 10 so that any flaws in the planar section are hidden from view. The first substrate 10 is preferably fabricated from a paper composite material and includes a circular opening 11 to receive the blister 7 in snug relation. It is of course understood that the opening may be of any desired shape to allow retention of any particular item of memorabilia.

The assembly according to FIG. 1 also includes a cover 12 which has an opening 14 disposed therein to correspond to the opening in the first substrate 10. The cover 12 is shown in juxtaposition on top of the first substrate 10 and is coextensively adhered thereto. In this embodiment the cover 12 is selected from glass which exhibits significantly higher resistance to scratching than corresponding planar regions in the Applicants' admitted art.

Ordinarily the display enclosure 5 exhibits a secure/snug ft within openings in both first substrate 10 and cover 12 so that the need for a backing is not necessarily required. Alternatively the assembly can indeed further include a backing 15 (shown in phantom in FIG. 2) which backing abuts planar surfaces 13 of the display enclosure 5 so as to self-encapsulate the item of memorabilia within the apparatus.

In the preferred embodiment the first substrate 10 can include a plaque or descriptive material 16.

What is claimed is:

1. An improved assembly for preserving and displaying an item of memorabilia in three dimensions including:

a first planar substrate, said first substrate having an opening;

a second hard transparent layer, said transparent layer adapted to co-extensively abut a surface of said first substrate, said transparent layer having an opening therein corresponding to said opening in said first substrate;

a transparent memorabilia enclosure adapted to fit securely within said openings of said first substrate and said second layer wherein the transparent memorabilia enclosure has a shaped portion and a planar region, said shaped portion including a periphery and being shaped to receive the item of memorabilia therein, said planar region extending about the periphery of the shaped portion and being adapted to abut an inner surface of the first substrate away from the transparent layer, said transparent memorabilia enclosure extending upwardly through said openings sitting proud of said transparent layer thus displaying the item of memorabilia held therein in three dimensions.

2. The assembly according to claim 1 wherein the planar region and the shaped portion of said memorabilia enclosure are joined substantially at right angles to each other.

3. The assembly according to claim 1 further including an opaque backing board so as to sandwich the planar region of said enclosure between said backing board and said first substrate.

4. The assembly according to claim 1 further including one or more information plaques.

5. The assembly according to claim 1, further including one or more photographs disposed between said transparent layer and said first substrate.

6. The assembly according to claim 5, further including one or more information plaques disposed between said transparent layer and said first substrate.

7. A method of preserving and displaying an item of memorabilia comprising:

providing a display assembly including:

a first planar substrate, said first substrate having an opening;

a second hard transparent layer, said transparent layer adapted to co-extensively abut a surface of said first substrate, said transparent layer having an opening therein corresponding to said opening in said first substrate; and a transparent memorabilia enclosure adapted to fit securely within said openings of said first substrate and said second layer wherein the transparent memorabilia enclosure has a shaped portion and a planar region, said shaped portion including a periphery and being shaped to receive the item of memorabilia therein, said planar region extending about the periphery of the shaped portion and being adapted to abut an inner surface of the first substrate away from the transparent layer, said transparent memorabilia enclosure extending upwardly through said openings sitting proud of said transparent layer thus displaying the item of memorabilia held therein in three dimensions; and placing the item within said enclosure;

placing said enclosure within said opening in said first substrate; and adhering said second transparent layer onto said first substrate.

* * * * *